US007441542B2

(12) United States Patent
Asanuma et al.

(10) Patent No.: US 7,441,542 B2
(45) Date of Patent: Oct. 28, 2008

(54) BUTTERFLY VALVES AND INTAKE AIR CONTROL DEVICES FOR INTERNAL COMBUSTION ENGINES

(75) Inventors: Hiroshi Asanuma, Obu (JP); Takuji Nakamura, Kariya (JP)

(73) Assignees: Aisan Kogyo Kabushiki Kaisha, Obu-shi, Aichi-ken (JP); Denso Corporation, Kariya-shi, Aichi-ken (JP)

( * ) Notice: Subject to any disclaimer, the term of this patent is extended or adjusted under 35 U.S.C. 154(b) by 0 days.

(21) Appl. No.: 11/868,083

(22) Filed: Oct. 5, 2007

(65) Prior Publication Data

US 2008/0092848 A1 Apr. 24, 2008

(30) Foreign Application Priority Data

Oct. 18, 2006 (JP) ..... 2006-283736

(51) Int. Cl.
*F02D 9/08* (2006.01)

(52) U.S. Cl. ..... 123/337

(58) Field of Classification Search ..... 123/337, 123/336, 399, 361; 251/304–309
See application file for complete search history.

(56) References Cited

U.S. PATENT DOCUMENTS

| | | | | |
|---|---|---|---|---|
| 7,055,497 | B2 * | 6/2006 | Maehara et al. | 123/336 |
| 7,080,628 | B2 * | 7/2006 | Kado et al. | 123/399 |
| 7,337,764 | B2 * | 3/2008 | Pringle et al. | 123/337 |

FOREIGN PATENT DOCUMENTS

JP 2001-074156 A 3/2001

* cited by examiner

*Primary Examiner*—Hieu T Vo
(74) *Attorney, Agent, or Firm*—Dennison, Schultz & MacDonald

(57) ABSTRACT

The present invention includes a butterfly valve that has a resin valve body and a shaft. The shaft includes a first shaft member and a second shaft member. The first and second shaft members are integrated with the valve body. The first and second shaft members are spaced from each other in an axial direction by a predetermined distance.

16 Claims, 8 Drawing Sheets

BUTTERFLY VALVES AND INTAKE AIR CONTROL DEVICES FOR INTERNAL COMBUSTION ENGINES

This application claims priority to Japanese patent application serial number 2006-283736, the contents of which are incorporated herein by reference.

BACKGROUND OF THE INVENTION

1. Field of the Invention

The present invention relates to butterfly valves. The present invention also relates to intake air control devices that have butterfly valves and are used for internal combustion engines.

2. Description of the Related Art

Japanese Laid-Open Patent Publication No. 2001-74156 teaches a known butterfly valve. This butterfly valve has a throttle shaft that is a one piece member integrated with a valve body by an insertion molding process. Therefore, during the molding process, the flowability of a molten resin for molding the valve body around the throttle shaft may be low, and therefore, the quality of the butterfly valve may be degraded in some cases. Thus, when the molten resin injected into a molding die flows in a diametrical direction with respect to the throttle shaft, the molten resin may impinge on the throttle shaft so as to be diverged into two streams in different directions, which streams flow about the throttle shaft by a distance corresponding to half the circumferential length of the throttle shaft for filling the space around the throttle shaft with the molten resin. Therefore, in the region on the backside of the throttle shaft with respect to the direction of flow of the molten resin toward the throttle shaft, a cavity blank or a weld line may be formed to cause improper molding. As a result, the quality of the throttle valve may be degraded.

Therefore, there is a need in the art for a butterfly valve that is improved in quality. Also, there is a need in the art for an intake air control device having a butterfly valve that is improved in quality.

SUMMARY OF THE INVENTION

A butterfly valve has a resin valve body and a shaft that includes a first shaft member and a second shaft member. The first and second shaft members are integrated with the valve body, while the first and second shaft members are spaced from each other in an axial direction by a predetermined distance. Therefore, during a molding process of the valve body, a flow path having a width corresponding to the distance between the first shaft member and the second shaft member can be ensured for the flow of the molten resin.

DETAILED DESCRIPTION OF THE INVENTION

Figure 1:
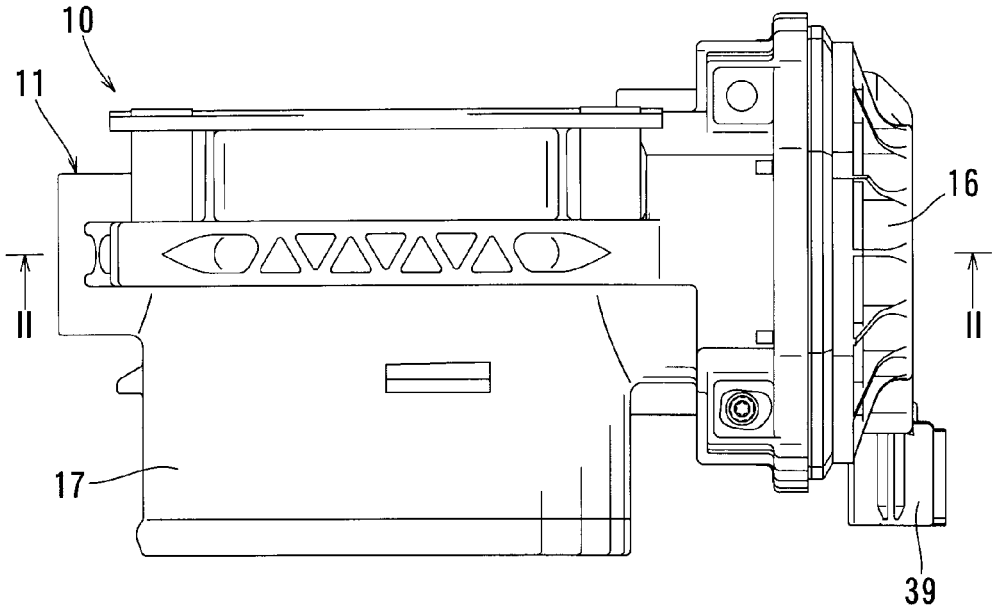
FIG. 1 is a plan view of a throttle control device for an internal combustion engine according to an embodiment of the present invention.

Each of the additional features and teachings disclosed above and below may be utilized separately or in conjunction with other features and teachings to provide improved butterfly valves and intake air control devices having such butterfly valves. Representative examples of the present invention, which utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a butterfly valve includes a support member defining a flow path, a plate-like valve body, and a shaft integrated with the valve body by an insertion molding process. The plate-like body is positioned within the flow path for opening and closing the flow path. The shaft includes a first shaft member and a second shaft member. The first and second shaft members are spaced from each other in the axial direction by a predetermined distance.

Therefore, during the molding process of the valve body, a flow path having a width corresponding to the distance between the first shaft member and the second shaft member can be ensured for the flow of the molten material. Therefore, the flowability of the molten material can be improved, and eventually, the quality of the butterfly valve can be improved.

The valve body may have a support shaft portion supported by the support member via bearings. Alternatively, each of the first and second shaft members may have a support shaft portion supported by the support member via a bearing. The valve body may have a plate-like portion positioned between the first and second shaft members. An expression of $\phi d \geqq t$ may be satisfied. Here, $\phi d$ is an outer diameter of the support portion and t is a thickness of the plate-like portion.

With this arrangement, it is possible to reduce the resistance of the valve body against flow of a fluid flowing through the flow path, in particular when the valve body is in a fully opened position.

The valve body may be made of resin material. Each of the first and second shaft members may have an embedded portion embedded within the valve body. The embedded portion of at least one of the first and second shaft members may include an engaging portion engaging with the resin material of the valve body. With this arrangement, it is possible to improve the coupling strength between the at least one of the first and second shaft members and the valve body.

The engaging portion may be configured to prevent the valve body from rotating about the rotational axis relative to the at least one of the first and second shaft members. With this arrangement, it is possible to improve the coupling strength with respect to the rotational direction between the at least one of the first and second shaft members and the valve body.

Alternatively, the engaging portion may be configured to prevent the valve body from moving in the axial direction relative to the at least one of the first and second shaft members. With this arrangement, it is possible to improve the coupling strength with respect to the axial direction between the at least one of the first and second shaft members and the valve body.

The engaging portion may include a rugged portion formed by knurling, so that the valve body can be prevented from rotating and from moving in the axial direction relative to the at least one of the first and second shaft members.

The first shaft member and the second shaft member may be made of different materials from each other. Therefore, the first and second shaft members can be made of materials that are suited to their functions.

The butterfly valve may further include a drive device coupled to the first shaft member via a metal coupling member. The first shaft member may be laser-welded to the metal coupling member. In such a case, each of the coupling member and the first shaft member may be made of stainless steel, and the second shaft member may be made of carbon steel with high carbon content.

In another embodiment, an intake air control device for an internal combustion engine includes a throttle valve that is the butterfly valve. The support member is a throttle body defining a bore as the flow path, so that an intake air can flow through the bore. The throttle valve is rotatably supported by the throttle body, so that an amount of the intake air flowing through the bore can be controlled as the bore is opened and closed by the throttle valve.

An embodiment of the present invention will now be described with reference to FIGS. 1 to 7. This embodiment relates to an intake air control device for an internal combustion engine, in particular to a throttle control device having a butterfly valve. In response to the amount of operation of an accelerator that is operated by an operator, such as a driver of an automobile, the throttle control device can control the rotational speed of an engine or an engine torque by varying the amount of flow of an intake air that flows into combustions chambers of engine cylinders. For example, the internal combustion engine may be a multicylinder gasoline engine. The throttle control device of this embodiment may be also called "electronically controlled throttle device" or "device for controlling an amount of intake air."

Figure 2:
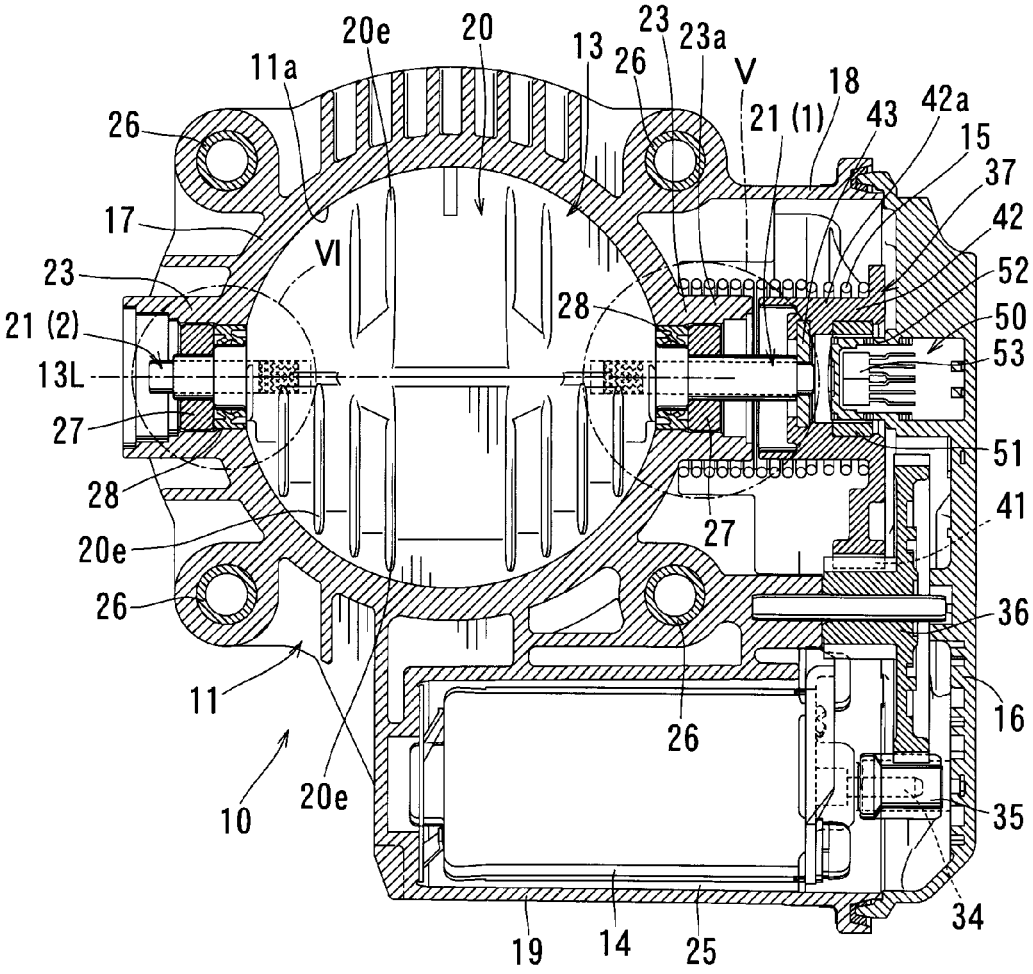
FIG. 2 is a cross-sectional view taken along line II-II in FIG. 1.

As shown in FIG. 2, a throttle control device 10 includes a throttle body 11, a throttle valve 13, a drive motor 14, a return spring 15 and an engine control unit (ECU) (not shown). A bore 11*a* is defined within the throttle body 11 and serves as an intake air channel, through which an intake air is supplied to cylinders of an internal combustion engine (not shown). The throttle valve 13 can control the amount of flow of the intake air that flows through the bore 11*a*. The drive motor 14 can actuate the throttle valve 13 to rotate in a valve opening direction or a valve closing direction. The return spring 15 is formed of a coil spring and biases the throttle valve 13 in the valve closing direction. The engine control unit (ECU) can control the rotational angle of the throttle valve 13, i.e., the opening of the throttle valve 13, in response to the amount of operation of the accelerator by the driver.

The throttle body 11 is configured as a housing that rotatably supports the throttle valve 13 therein. One end of the throttle body 11 is joined to an upstream-side end of an intake manifold (not shown) of the engine by fasteners, such as fixing bolts and tightening screws. A cover member 16 is attached to the outer side (right side as viewed in FIG. 2) of the throttle body 11. The throttle body 11 is a one piece member molded by resin and includes a hollow cylindrical bore wall portion 17 as a primary element. The throttle body 11 also includes a gear box portion 18 and a motor housing portion 19. Within the gear box portion 18, gears of a reduction gear mechanism are rotatably supported. The motor housing portion 19 has a hollow cylindrical tubular configuration for accommodating the drive motor 14.

The intake air can flow towards the engine cylinders via the bore 11 that is defined as a hollow space within the bore wall portion 17. The upstream-side end (lower end as viewed in FIG. 1 or right end as viewed in FIG. 3) of the bore wall portion 17 is sealingly coupled to an air cleaner (not shown) via an intake air duct (not shown). The air cleaner serves to filtrate the intake air. The downstream-side end (upper end as viewed in FIG. 1 or left end as viewed in FIG. 3) of the bore wall portion 17 is sealingly coupled to the intake manifold. Although not shown in the drawings, a surge tank for suppressing the pulsation of the intake air may be interleaved between the bore wall portion 17 and the intake manifold. In this way, the throttle body 11 serves as a flow path defining member, and the bore 11*a* serves as a flow path for the flow of the intake air.

As shown in FIG. 2, the throttle valve 13 includes a disc-shaped resin valve body 20 and a pair of right and left metal shaft members 21. The valve body 20 is positioned within the bore 11*a*. The shaft members 21 are disposed on opposite sides of the valve body 20. The bore wall portion 17 of the throttle body 11 rotatably supports the throttle valve 13 via bearings 27. The shaft members 21 are integrated with the valve member 20 by an insertion molding process, so that the shaft members 21 are respectively positioned on the right side and the left side of the valve member 20 so as to be symmetrical with each other. In addition, the shaft members 21 extend along a rotational axis 13L of the valve member 20. The rotational axis 13L extends across the valve body 20 in the diametrical direction (right and left directions as viewed in FIG. 2). One of the shaft members 21 positioned on the right side as viewed in FIG. 2 will be hereinafter also called "shaft member 21(1). The other of the shaft members 21 positioned on the left side will be hereinafter also called "shaft member 21(2)."

Figure 5:
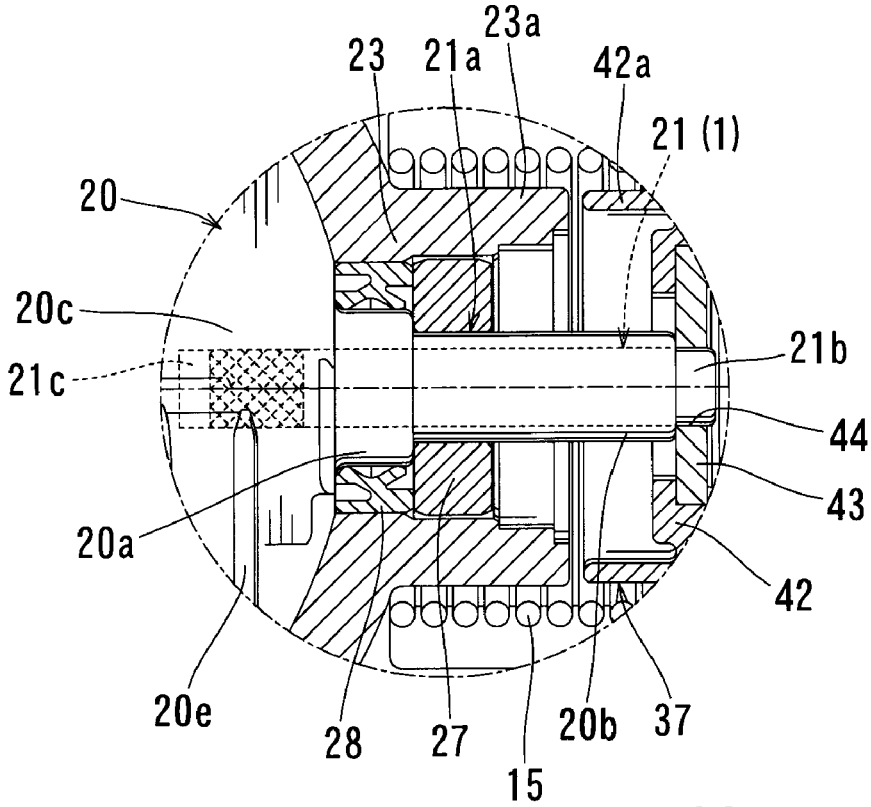
FIG. 5 is an enlarged view of a region V of FIG. 2.
Figure 6:
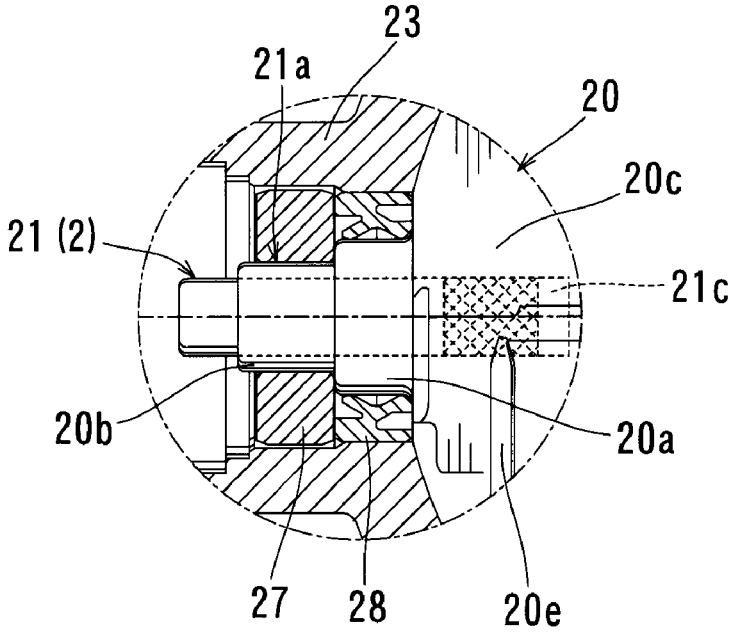
FIG. 6 is an enlarged view of a region VI of FIG. 2.
Figure 7:
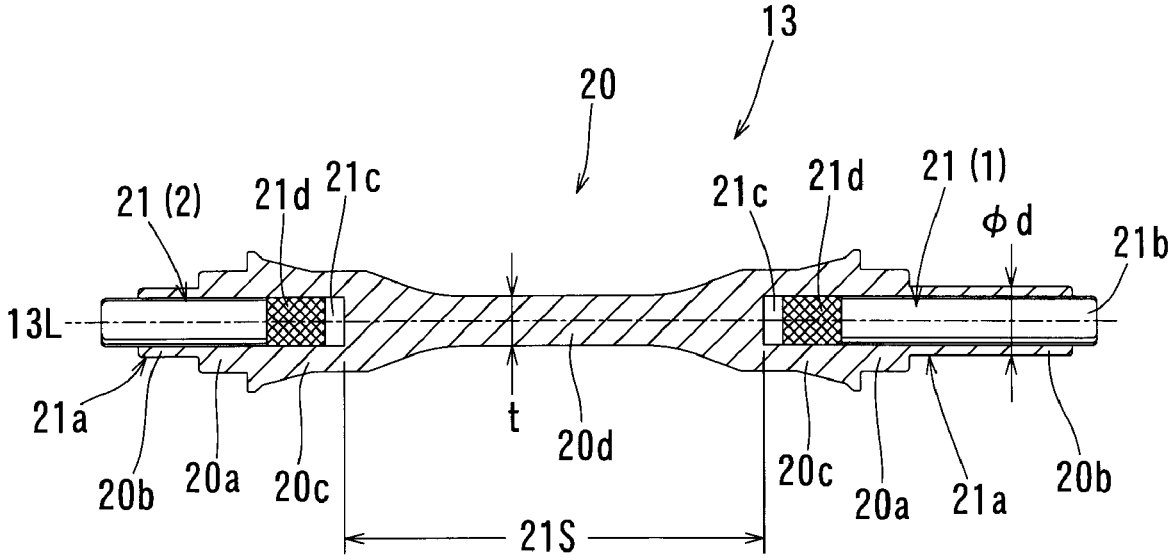
FIG. 7 is a cross-sectional view of a throttle valve.

As shown in FIGS. 5 to 7, the base portions or the radially inner portions of the shaft members 21(1) and 21(2) are embedded within respective shaft covering portions 20*c* of the valve member 20, so that the base portions are configured as embedded portions 21*c*. Almost of the remaining portion of each shaft member 21 is covered by cylindrical sleeve portions 20*a* and 20*b* that are formed in series with each other and in continuity with the corresponding shaft covering portion 20*c*. The outer diameter of the sleeve portion 20*a* is larger than the outer diameter of the sleeve portion 20*b*, so that a stepped portion is formed between the outer surface of the sleeve portion 20*a* and the outer surface of the sleeve portion 20*b*. A seal member 28 is fitted onto the sleeve portion 20*a* that is formed in series with the shaft covering portion 20*c*. The bearing 27 is fitted onto the sleeve portion 20*b* that is formed in series with the sleeve portion 20*a* as described above. The radially outer end of the shaft portion 21 extends beyond the radially outer end of the sleeve portion 20*b* and is exposed to the outside of the sleeve portion 20*b*.

The throttle valve 13 configured as described above is of a type called "butterfly valve." A portion of each shaft member 21 received within the sleeve portion 20*b*, onto which the bearing 27 is fitted, will be hereinafter called "support shaft portion 21*a*."

As shown in FIG. 2, a pair of bearing support portions 23 having hollow cylindrical configurations are formed on the bore wall portion 17 for rotatably supporting the shaft members 21(1) and 21(2) of the throttle valve 13. The bearing support portions 23 have radially outer ends that protrude radially outward from the outer surface of the bore wall portion 17. The outer end of one of the bearing support portions 23 (one positioned on the right side as viewed in FIG. 2) is configured as a spring guide 23*a*, onto which the left end (as viewed in FIG. 2) of the return spring 15 is fitted. The spring guide 23*a* provides a guide for the return spring 15 and holds the left end of the return spring 15. Although not shown in the drawings, a latching portion for latching one of the terminal ends of the return spring 15 on the side of the throttle body 11 is provided on the base end portion (left end portion as viewed in FIG. 2) of the spring guide 23*a*.

Figure 3:
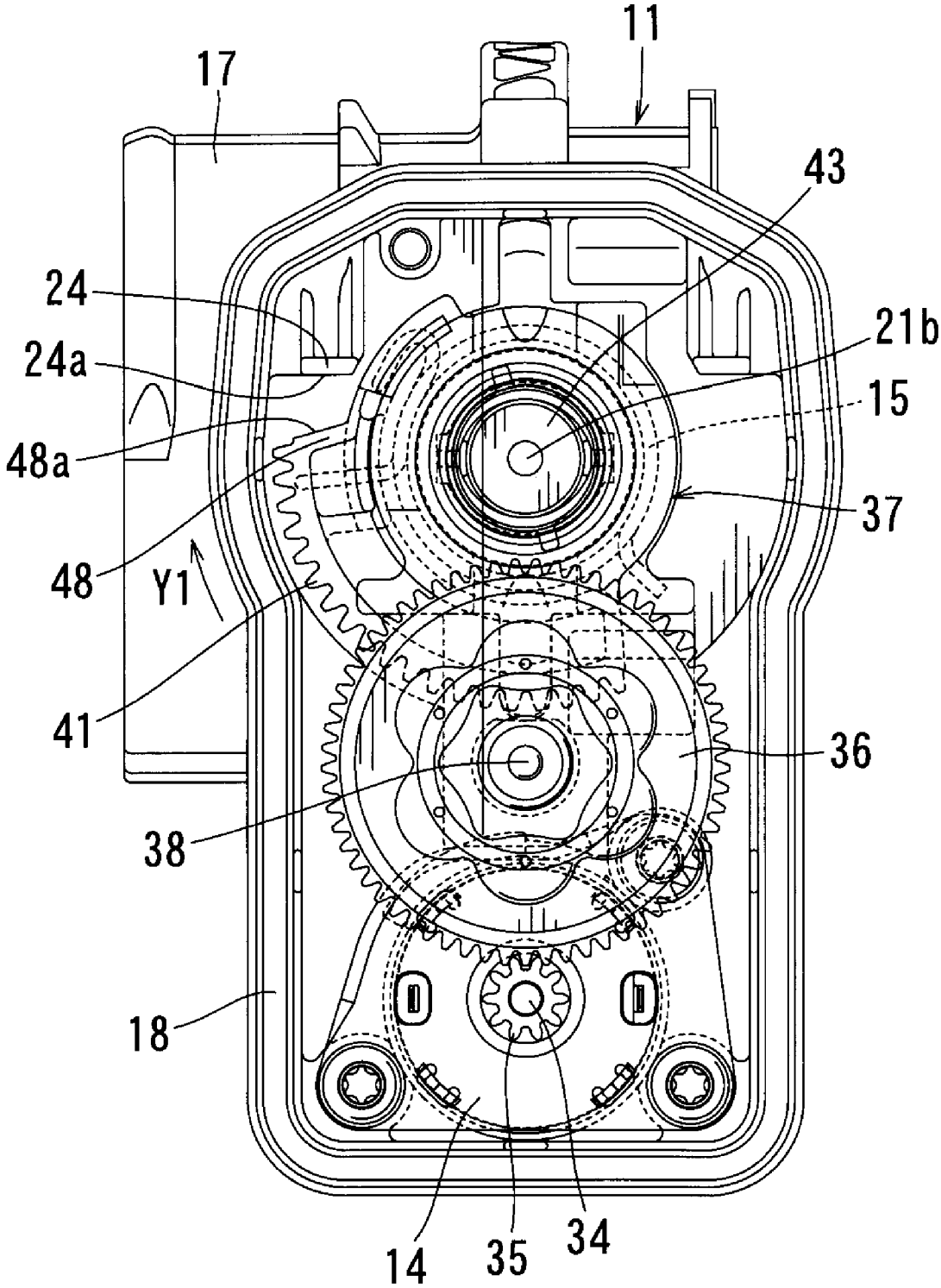
FIG. 3 is a side view of a throttle body in the sate where a cover member has been removed.

The gear body portion 18 is formed integrally with the outer circumferential part (in particular, the right side of the outer circumferential part) of the bore wall portion 17. The inner space of the gear body portion 18 serves as a gear chamber for rotatably receiving gears of the reduction gear mechanism that will be explained later. As shown in FIG. 3, a block-like stopper 24 is formed integrally with the inner wall of a predetermined part (left upper part as viewed in FIG. 3 in this embodiment) of the gear box portion 18 for stopping rotation of the throttle valve 13 at a fully closed position when the throttle valve 13 rotates toward the fully closed position. More specifically, the stopper 24 has a stopper face 24*a* (lower end face as viewed in FIG. 3) that can contact in face-to-face contact relation with a contact face 48*a* formed on a contact portion 48 of a throttle gear 37 when the throttle valve 13 has been fully closed.

As shown in FIG. 2, the motor housing portion 19 is formed integrally with the outer circumferential part (in particular, the lower side of the outer circumference part) of the bore wall portion 17. The inner space of the motor housing portion 18 is configured as a motor accommodating region 25 for receiving and supporting the drive motor 14. The motor accommodating region 25 has a longitudinal axis extending in right and left directions as viewed in FIG. 2. The longitudinal axis of the motor accommodating region 25 is parallel to the rotational axis 13L of the throttle valve 13. Cylindrical collars 26 are fitted into the outer circumferential part of the bore wall portion 17. Fasteners, such as fixing bolts and fastening screws, can be inserted into the cylindrical collars 26 for fastening and fixing the downstream-side end of the throttle body 11 to the upstream-side end of the intake manifold.

The valve body 20 of the throttle valve 13 is positioned within the bore 11*a* of the throttle body 11 for opening and closing the bore 11*a*. The rotational axis 13L of the throttle valve 13 is substantially perpendicular to the direction of the average flow of the intake air, which direction is substantially perpendicular to the sheet of FIG. 2. The valve body 20 has a circular disc-like configuration to correspond to the cross sectional configuration of the bore 11*a*. The rotational position of the throttle valve 13 (i.e., the degree of opening of the throttle valve 13) can be varied between a fully closed position and a fully opened position, so that the amount of intake air supplied to the engine cylinders can be controlled. In the fully closed position, a predetermined minimum clearance is produced between the outer circumferential portion (i.e., the outer circumferential end face) of the valve body 20 and the wall surface of the bore 11*a* (i.e., the inner diameter of the bore 11*a*) of the throttle body 11, so that the amount of flow of the intake air is minimized. In the fully open position, a predetermined maximum clearance is produced between the outer circumferential portion of the valve body 20 and the wall surface of the bore 11*a* of the throttle body 11, so that the amount of flow of the intake air is maximized.

As shown in FIGS. 5 and 7, the small-diameter sleeve portions 20*b* that cover the shaft members 21(1) and 21(2) of the throttle valve 13 are rotatably supported by the corresponding bearing support portions 23 of the throttle body 11 via the bearings 27. In this embodiment, the bearings 27 are slide bearings. The shaft member 21(1) positioned on the side of the gear box portion 18 (on the right side as viewed in FIG. 2) serves as a drive-side shaft member. The shaft member 21(2) positioned on the opposite side (on the left side as viewed in FIG. 2) serves as a driven-side shaft member. Each of the seal members 28 has an annular configuration. The seal members 28 are interleaved between the large-diameter sleeve portions 20*a* and the bearing support portions 23 (see FIGS. 5 and 7). The seal members 28 have resiliency for hermetically sealing between the large-diameter sleeve portions 20*a* and the bearing support portions 23. The configurations of the shaft members 21(1) and 21(2) are substantially the same with each other. In addition, the configurations of the sleeve portions 20*a* as well as the configurations of the sleeve portions 20*b* are substantially the same with each other. However, the axial length of the small-diameter sleeve portion 20*b* associated with the drive-side shaft member 21(1) is longer than the axial length of the small-diameter sleeve portion 20*b* associated with the driven-side shaft member 21(2) by a predetermined length (e.g., by two or three times as the axial length of the small-diameter sleeve portion 20*b* associated with the driven-side shaft member 21(2)). As shown in FIG. 2, the radially outer end of the drive-side shaft member 21(1) exposed from radially outer end face of the associated small-diameter sleeve portion 20*b* is configured as a connecting shaft portion 21*b* for coupling to the throttle gear 37.

As shown in FIG. 2, a power unit for rotatably driving the throttle valve 13 toward the opening direction or the closing direction includes the drive motor 14 and the reduction gear mechanism that serves as a power transmission mechanism for transmitting the rotational torque of the drive motor 14 to the throttle valve 13 (more specifically, the drive-side shaft member 21(1). The drive motor 14 is electrically connected to power supply terminals (not shown) embedded within the cover member 16, so that an electric power can be supplied to the drive motor 14 via the power supply terminals for rotating a motor shaft 34 of the drive motor 14 in a forward direction or a reverse direction. In other words, the drive motor 14 serves as an electrically driven actuator or a drive source. The reduction gear mechanism serves to reduce the rotational speed of the drive motor 14 by a predetermined reduction ratio. The reduction gear mechanism includes a pinion gear 35, an intermediate reduction gear 36 and the throttle gear 37. The pinion gear 35 is fixedly mounted to the motor shaft 34 of the drive motor 14. The intermediate reduction gear 36 is in engagement with the pinion gear 35 and can rotate as the pinion gear 35 rotates. The throttle gear 37 is in engagement with the intermediate reduction gear 36 and can rotate as the intermediate reduction gear 36 rotates. The intermediate reduction gear 36 is supported on a support shaft 38, so that the intermediate reduction gear 36 can rotate about the support shaft 38. The intermediate reduction gear 36 has a large-diameter gear portion and a small-diameter gear portion that has the same axis as the large-gear portion. The large-diameter gear portion is in engagement with the pinion gear 35 and the small-diameter gear portion is in engagement with the throttle gear 37.

As shown in FIG. 2, the cover member 16 is molded into one piece by a resin material, which preferably has an electrically insulating property for insulating between terminals of a rotational angle sensor and between the power supply terminals for the supply of power to the drive motor 14. The rotational angle sensor will be explained later. The cover member 16 is attached to an open end portion of the gear box portion 18 by a suitable means, such as rivets, screws, clips, welding and adhesion, so that the inner space of the gear box portion 18 is closed off from the outside environment. An external electrical connector (not shown) can be connected to a connector portion 39 formed integrally with the cover member 16 (see FIG. 1).

The throttle gear 37 is molded into one piece by a thermoplastic resin material and serves as a rotary driver. As shown in FIG. 2, a sector gear portion 41 is formed integrally with the outer circumferential portion of the throttle gear 37 and is in engagement with the intermediate reduction gear 36 (more specifically, the small diameter gear portion of the intermediate reduction gear 36). A hollow cylindrical tubular portion 42 is formed integrally with the inner circumferential portion of the gear portion 41 and protrudes toward the side of the bottom of the gear box portion 18 (leftward as viewed in FIG. 2). The outer circumference of the protruded part of the tubular portion 42 is configured as a spring guide 42*a*, onto which the right end (as viewed in FIG. 2) of the return spring 15 is fitted. The spring guide 42*a* provides a guide for the return spring 15 and holds right end of the return spring 15. Although not shown in the drawings, a latching portion for latching the right terminal end of the return spring 15 on the side of the throttle gear 37 is provided on the base end portion (right end portion as viewed in FIG. 2) of the spring guide 42*a*.

An annular plate-like coupling member 43 is made of metal, such as stainless steel, and is integrated with the inner circumference of the tubular portion 42 by an insertion molding process. As shown in FIG. 5, a coupling hole 44 is formed in the central portion of the coupling member 43 for fitting with the connecting shaft portion 21*b* of the drive-side shaft member 21(1) (see FIG. 4). The coupling member 43 of the throttle gear 37 and the connecting shaft portion 21*b* of the drive-side shaft member 21(1) are joined together by a laser-welding technique after they are fitted with each other (see FIG. 2).

Figure 4:
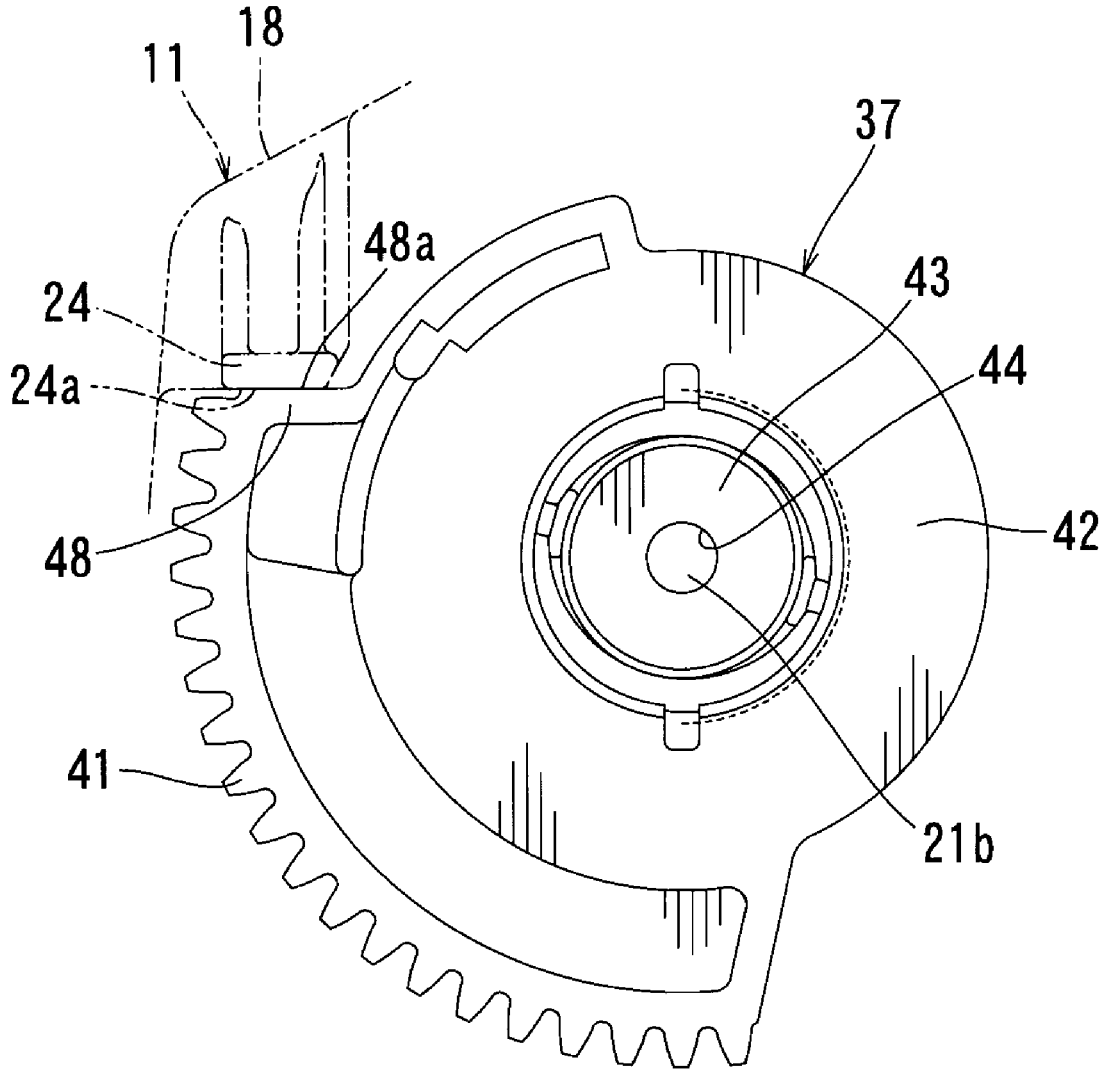
FIG. 4 is a side view of a throttle gear.

As shown in FIG. 4, the contact portion 48 is formed integrally with the outer peripheral portion of the throttle gear 37. The contact portion contacts with the stopper 24 disposed within the gear box portion 18 of the throttle body 11 when the throttle valve 13 is in the fully closed position. More specifically, the circumferential end in the clockwise direction as viewed in FIG. 4 of the gear portion 41 forms the contact portion 48. As described previously, the contact portion 48 has the contact face 48*a* that can contact in face-to-face contact relation with the stopper face 24*a* of the stopper 24 of the throttle body 11 when the throttle valve 13 has been fully closed.

Referring to FIG. 2, the throttle control device 10 is provided with a throttle position sensor 50. The throttle position sensor 50 is operable to convert the rotational angle (degree of opening) of the throttle valve 13 into an electrical signal (opening degree signal) and to output the electrical signal to the engine control unit (ECU). The throttle position sensor 50 includes magnets 51 and yokes (not shown), which are fixedly attached to the inner circumference of the tubular portion 42 of the throttle gear 37 by means of adhesion or the like. The throttle position sensor 50 also includes a non-contact magnetic detecting element 53 that is assembled to a sensor mount 52 provided on the cover member 16. The magnets 51 are formed of permanent magnets that are separated from each other. The yokes are made of magnetic material that can be magnetized by the magnets 51. The yokes are separated from each other. The sensor mount 52 protrudes from the inner wall of the cover member 16 in a direction inwardly of the cover member 16 (leftward as viewed in FIG. 2) so as to be inserted into the inner space of the tubular portion 42 of the throttle gear 37, while a predetermined gap is provided between the sensor mount 52 and the inner wall of the tubular portion 42. The magnetic detecting element 53 can output a signal corresponding to the density of the magnetic flux produced in the space within the tubular portion 42 of the throttle gear 37 and intersecting with the magnetic detecting element 53. The magnetic detecting element 53 may be a Hall element, a Hall IC or a magneto resistive element.

In addition to the throttle position sensor 50, an accelerator opening sensor (not shown) is electrically connected to the engine control unit (ECU). The accelerator opening sensor can convert the amount of operation of an accelerator by a driver (i.e., a depressing amount of an accelerator pedal) into an electric signal (i.e., an accelerator opening signal) and can output the electric signal to the engine control unit (ECU). The engine control unit (ECU) performs a feedback control of the drive motor 14 based on a proportional-integral-derivative control technique (PID control technique) in order that no difference is resulted between the throttle opening signal from the throttle position sensor 50 and the accelerator opening signal from the accelerator opening sensor.

A method of assembling the components of the throttle control device 10 will now be described with reference to FIG. 2. Prior to the assembling operation, the throttle body 11 is molded by resin, while the throttle valve 13 is inserted into a molding die of the throttle body 11.

First, the seal members 28 and the bearings 27 are fitted between the shaft members 21 (more specifically, the sleeve portions 20*a* and 20*b*) and the bearing support portions 23 of the throttle body 11 such that the shaft members 21 are rotatably supported by the bearing support portions 23 via the bearings 27. Thereafter, the left end portion as viewed in FIG. 2 of the return spring 15 is fitted on the spring guide 23*a* of the throttle body 11 and the terminal end of the left end portion of the return spring 15 is latched to the latching portion (not shown) of the spring guide 23*a*. Then, the right end portion of the return spring 15 is fitted on the spring guide 42*a* of the throttle gear 37 and the terminal end of the right end portion of the return spring 15 is latched to the latching portion (not shown) of the spring guide 42*a*.

Next, the connecting shaft portion 21*b* of the drive-side shaft member 21(1) of the throttle valve 13 is fitted into the coupling hole 44 of the coupling member 43 of the throttle gear 37. At this stage, the connecting shaft portion 21*b* can rotate within the coupling hole 44. As the connecting shaft portion 21*b* is fitted into the coupling hole 44, the radially outer end face of the small-diameter sleeve portion 20*b* is brought to contact with the end face of the coupling member 43, which axially opposes to the sleeve portion 20*b*.

Thereafter, the throttle gear 37 is rotated in the closing direction (clockwise direction as indicated by arrow Y1 in FIG. 3) until the contact face 48*a* of the contact portion 48 of the throttle gear 37 contacts in face-to-face contact relation with the stopper face 24*a* of the stopper 24 of the throttle body 11 (see FIG. 4). With the contact portion 48 of the throttle gear 37 contacting with the stopper 24 of the throttle body 11, an operator rotates the throttle valve 13 for adjusting a clearance that is produced when the throttle valve 13 is in the fully closed position (hereinafter called "clearance in fully closed position"). More specifically, a relative rotational angle (i.e., a relative mounting angle) between the throttle valve 13 and the throttle gear 37 is adjusted such that a predetermined amount of clearance is produced between the outer peripheral portion (i.e., the outer peripheral end face) of the valve body 20 of the throttle valve 13 and the wall surface of the bore 11*a* of the throttle body 11 without causing contact between the outer peripheral portion of the valve body 20 and the wall surface of the bore 11*a*.

After adjustment of the clearance in the fully closed position, the connecting shaft portion 21*b* of the drive-side shaft member 21(1) and the coupling member 43 are joined together by laser-welding along the entire circumference of the connecting shaft portion 21*b*. Thereafter, the drive motor 14, the support shaft 38 and the intermediate reduction gear 36 are assembled within the throttle body 11 at predetermined positions (see FIG. 3). Subsequently, the cover member 16 is attached to the throttle body 11, so that the throttle control device 10 is completed (see FIG. 2). A plug (not shown) can close the open end of the driven-side bearing support portion 23.

The operation of the throttle control device 10 according to this embodiment will now be described. When a driver of an automobile depresses the accelerator pedal, the accelerator opening sensor outputs an accelerator opening signal to the engine control unit (ECU). Then, the engine control unit (ECU) supplies a power to the drive motor 14 to rotate the motor shaft 34 so that the valve body 20 of the throttle valve 13 can be positioned at a target angular position. Thus, the rotational torque of the drive motor 14 is transmitted to the throttle gear 37 via the pinion gear 35 and the intermediate reduction gear 36, so that the throttle gear 37 rotates by an angle corresponding to the depressing amount of the accelerator pedal against the biasing force of the return spring 15. As the throttle gear 37 rotates, the throttle valve 13 rotates from the fully closed position to the target angular position toward the fully open position. As a result, the intake air channel is opened to vary the rotational speed of the engine to correspond to the depressing amount of the accelerator pedal.

As the driver releases his or her foot from the accelerator pedal, the throttle valve 13 and the throttle gear 37 are forced to return to their original positions by the biasing force of the return spring 15, so that the throttle valve 13 returns to the fully closed position. Because the accelerator opening sensor outputs the accelerator opening signal, the engine control unit (ECU) can drive the drive motor 14 in the reverse direction based on the accelerator opening signal such that the throttle valve 14 is moved to the fully closed position as the driver releases the accelerator pedal.

Therefore, the throttle valve 13 can rotate from the open position toward the fully closed position by the biasing force of the return spring 15 until the contact face 48*a* of the contact portion 48 of the throttle gear 37 contacts with the stopper face 24*a* of the stopper 24 on the side of the throttle body 11. The throttle valve 13 cannot rotate further in the closing direction after the contact face 48*a* of the contact portion 48 has contacted with the stopper face 24*a* of the stopper 24. Therefore, the throttle valve 13 can be held in the fully closed position (see FIG. 4). In this way, the angular position of the valve body 20 of the throttle valve 13 in the fully closed position can be maintained such that a predetermined clearance (i.e., a clearance in fully closed position) is ensured between the outer peripheral portion (outer peripheral end face) of the valve body 20 of the throttle valve 13 and the wall surface of the bore 11*a* of the throttle body 11. Therefore, an amount of intake air can still be supplied to the engine cylinders when the throttle valve 13 is in the fully closed position during the idle driving operation. In other words, a predetermined amount of leakage of intake air can be ensured when the throttle valve 13 is in the fully closed position. A bypass channel (not shown) can be provided that bypasses the valve body 20 of the throttle valve 30. A solenoid valve (not shown) can be provided in the bypass channel for controlling the flow of the intake air through the bypass channel, so that the rotational speed of the engine can be controlled to a target idle rotational speed by the solenoid valve. However, such control of the rotational speed of the engine can be performed without using the bypass channel and the solenoid valve. Thus, driving the drive motor 14 can change the position of the throttle valve 13 from the fully closed position toward the fully opened position. When the throttle valve 13 has rotated by a suitable angle, the drive motor 14 is stopped, so that the rotational speed of the engine can be controlled to a target idle rotational speed.

The throttle valve 13 will be described in more detail. Referring to FIG. 7, the shaft members 21(1) and 21(2) of the throttle valve 13 jointly constitute a single shaft. In other words, a single shaft is divided into the shaft members 21(1) and 21(2) in the axial direction (right and left directions as viewed in FIG. 7). The shaft members 21(1) and 21(2) are integrated with the valve body 20, while they are spaced from each other by a distance 21S in the axial direction. On the outer surface of the embedded portion 21*c* of each of the shaft members 21(1) and 21(2), a mesh-like rugged part 21*d* is formed by a knurling work. Because the rugged part 21*d* is embedded within the valve body 20, the resin material of the valve member 20 may engage the rugged part 21*d*. Therefore, the rugged part 21*d* can prevent the valve member 20 from rotating and from moving axially relative to the shaft member 21. In this way, the rugged part 21*d* serves as an engaging part for engaging the valve body 20.

The shaft members 21(1) and 21(2) are formed separately from each other. Preferably, the shaft members 21(1) and 21(2) are made of different metal materials from each other. The metal material of the drive-side shaft member 21(1) may be chosen to be suitable for laser-welding the drive-side shaft member 21(1) to the coupling member 43 of the throttle gear 37. A suitable metal material for the drive-side shaft member 21(1) may include stainless steel with low carbon content. The driven-side shaft member 21(2) is not necessary to be laser-welded to the other member. Therefore, the driven-side shaft member 21(2) can be made of inexpensive steel material, such as S45C (carbon steel with high carbon content), which is inexpensive compared to stainless steel.

Each of the support shaft portions 21*a* of the shaft members 21(1) and 21(2) has an outer diameter ød. The valve body 29 has a plate-like portion 20*d* with a thickness t in a position between the shaft members 21(1) and 21(2). The outer diameter ød and the thickness t are determined such that they satisfy an expression of ød≧t. In this embodiment, the outer diameter ød is larger than the thickness t. In addition, in this embodiment, the center of the thickness t is positioned on the rotational axis 13L.

Further, in this embodiment, front and rear faces of the valve body 20 are configured to give a streamline shape such that the front and rear faces continue gently over the shaft covering portions 20*c* and the plate-like portion 20*d*. A suitable number of ribs 20*e* are formed on each of the front and rear faces of the valve body 20 and extend in directions orthogonal to the rotational axis 13L.

According to the throttle valve 13 of the throttle control device 10 (see FIG. 2) of this embodiment, the shaft is divided into two shaft members 21(1) and 21(2). The shaft members 21(1) and 21(2) are integrated with the valve body 20, while they are spaced from each other by the distance 21S in the axial direction with the valve body 20 positioned therebetween (see FIG. 7). Therefore, during the molding process of the valve member 20, a flow path having a width corresponding to the distance 21S between the shaft members 21(1) and 21(2) can be ensured for the flow of the molten resin. Therefore, the flowability of the molten resin can be improved, and eventually, the quality of the throttle valve 13 can be improved.

In addition, the valve body 20 has the plate-like portion 20*d* positioned between the shaft members 21(1) and 21(2) or between the shaft covering portions 20*c* (see FIG. 7). The thickness t of the plate-like portion 20*d* is set to satisfy the expression of ød≧t. Because the thickness t may have a relatively small value, it is possible to reduce or minimize the resistance against flow of the intake air when the valve member 20 is in the fully opened position.

Further, the rugged part 21*d* that can engage the resin material of the valve body 20 is formed on the embedded portion 21*c* of each of the shaft members 21(1) and 21(2). The embedded portion 21*c* is embedded within the shaft covering portion 20*c* (see FIG. 7). Therefore, it is possible to improve the coupling strength between the shaft members 21(1) and 21(2) and the valve body 20.

Furthermore, the rugged part 21*d* of each of the shaft members 21(1) and 21(2) is configured for preventing the valve body 20 from rotating in the circumferential direction of the valve body 20 and also from moving in the axial direction. Therefore, the coupling strength between the shaft members 21(1) and 21(2) and the valve body 20 can be improved both in the rotational direction and the axial direction of the valve body 20.

Still furthermore, the shaft members 21(1) and 21(2) are made of different materials from each other. More specifically, the drive-side shaft member 21(1) is made of metal material suited for laser-welding the shaft member 21(1) to the coupling member 43 of the throttle gear 37. On the other hand, the driven-side shaft member 21(2) is made of inexpensive metal material. In this way, it is possible to form the shaft members 21(1) and 21(2) by materials that are suited for their respective functions.

Furthermore, according to the above embodiment, the throttle control device 10 (see FIG. 2) is provided with the throttle valve 13 that is rotatably supported within the throttle body 11. The throttle valve 13 is operable to open and close the bore 11*a*, through which the intake air flows, for controlling the amount of flow of the intake air. Therefore, the throttle control device 10 can be improved, because it has the throttle valve 13 that is improved in quality as described above.

Another embodiment of the present invention will now be described with reference to FIGS. 8 to 11. This embodiment is a modification of the above embodiment. Therefore, like members are given the same reference numerals as the above embodiment and the description of these elements will not be repeated.

Figure 8:
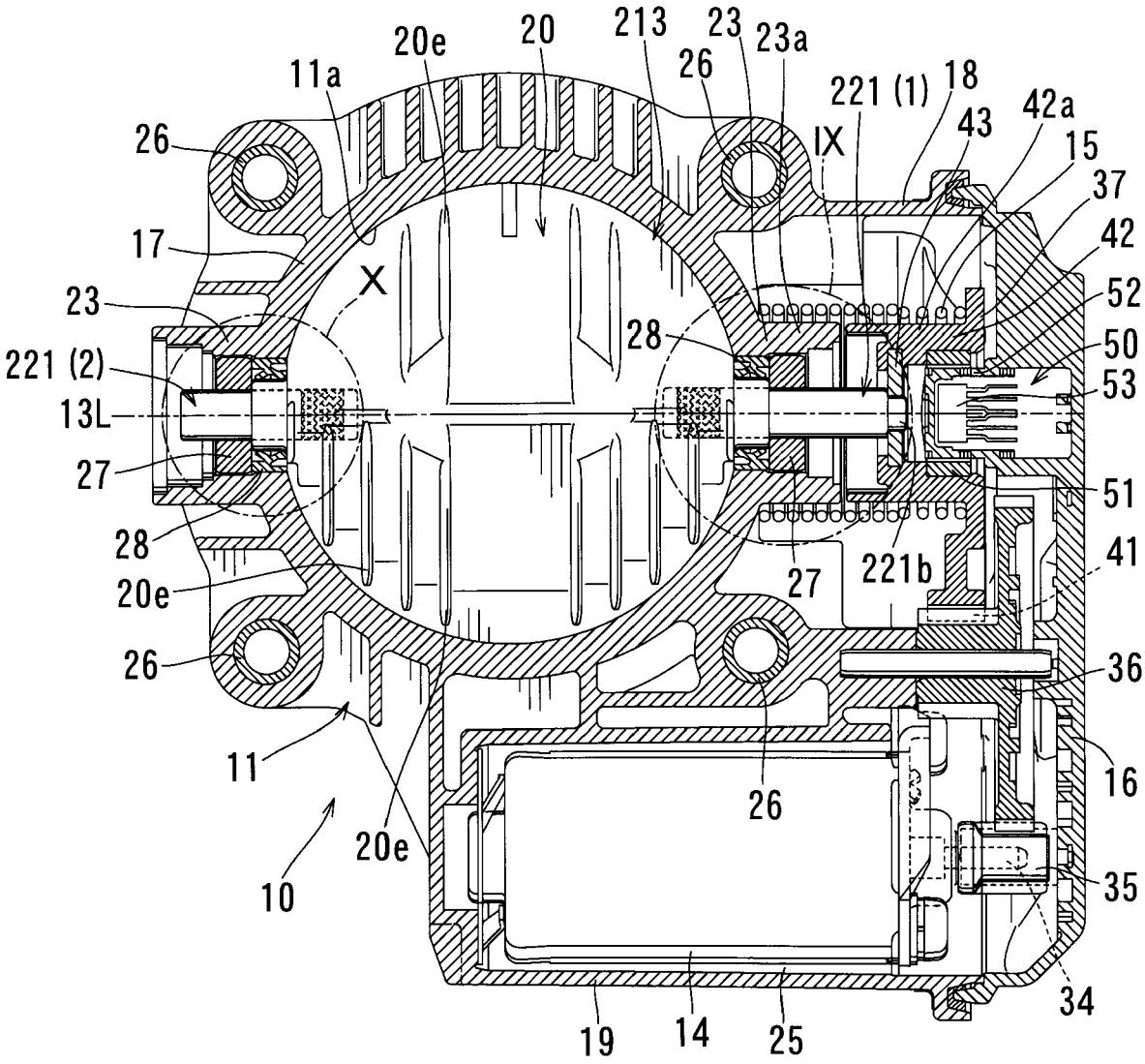
FIG. 8 is a cross-sectional view of a throttle control device for an internal combustion engine according to another embodiment of the present invention.
Figure 11:
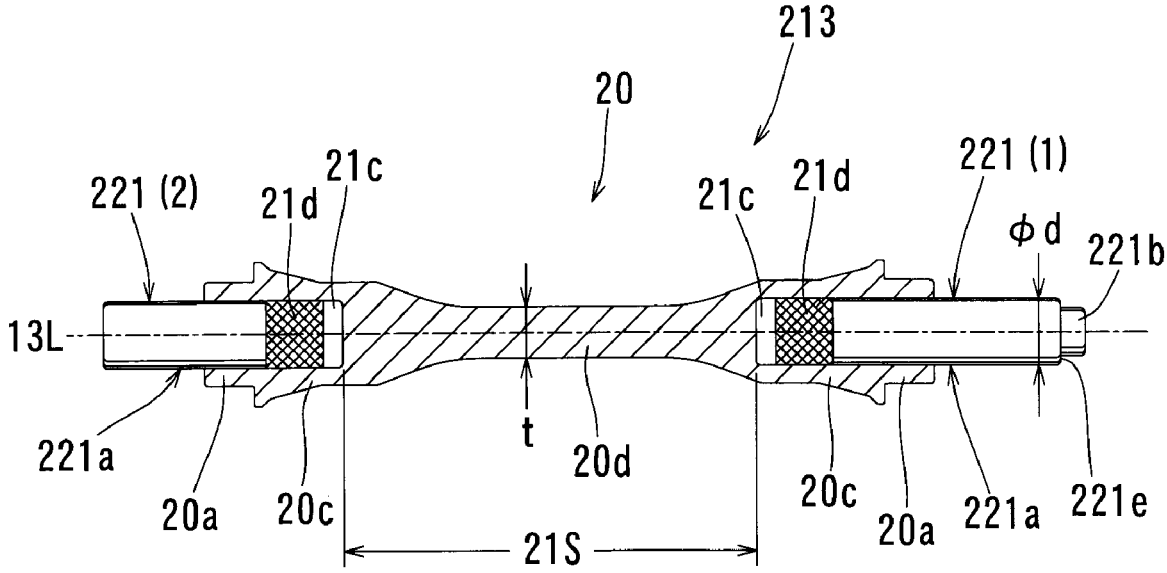
FIG. 11 is a cross-sectional view of a throttle valve shown in FIG. 8.

As shown in FIG. 8, a throttle valve 213 according to this embodiment includes shaft members 221(1) and 221(2) which respectively correspond to the shaft members 21(1) and 21(2) of the above embodiment. As shown in FIG. 11, each of the shaft members 221(1) and 221(2) is covered by the cylindrical sleeve portion 20*a* that is formed by the resin material in continuity with the corresponding shaft covering portion 20*c*. However, in this embodiment, the sleeve portion 20*b* having the outer diameter smaller than the outer diameter of the sleeve portion 20*a* is omitted. Therefore, the shaft members 221(1) and 221(2) extend radially outward beyond the radially outer ends of the cylindrical sleeve portions 20*a*, so that substantially half the length of each of the shaft members 221(1) and 221(2) is exposed to the outside.

Figure 9:
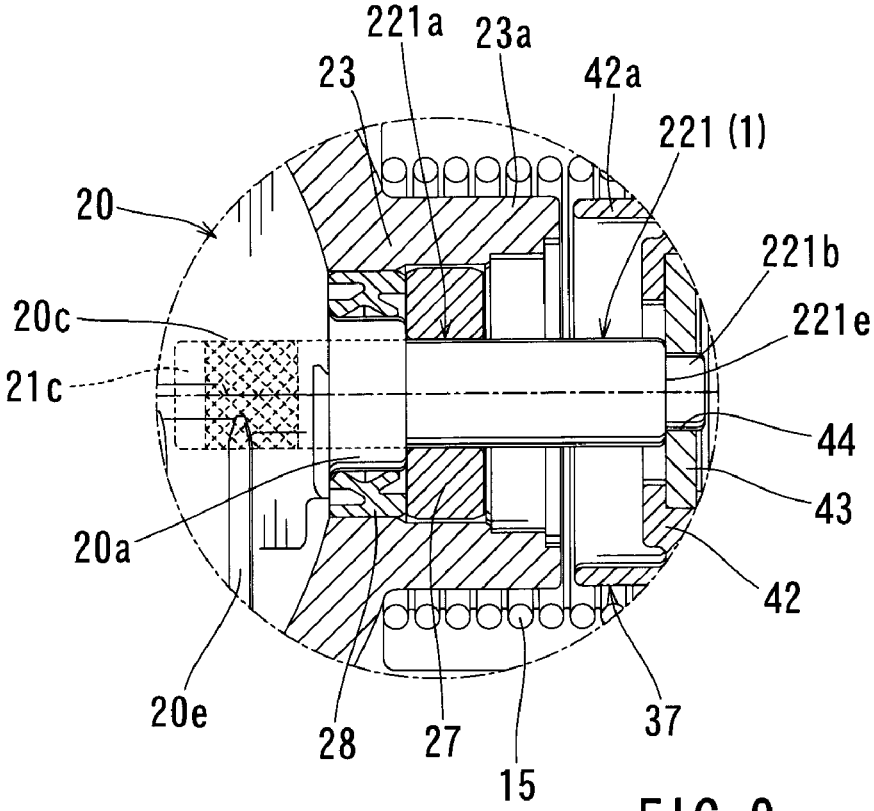
FIG. 9 is an enlarged view of a region IX o FIG. 8.
Figure 10:
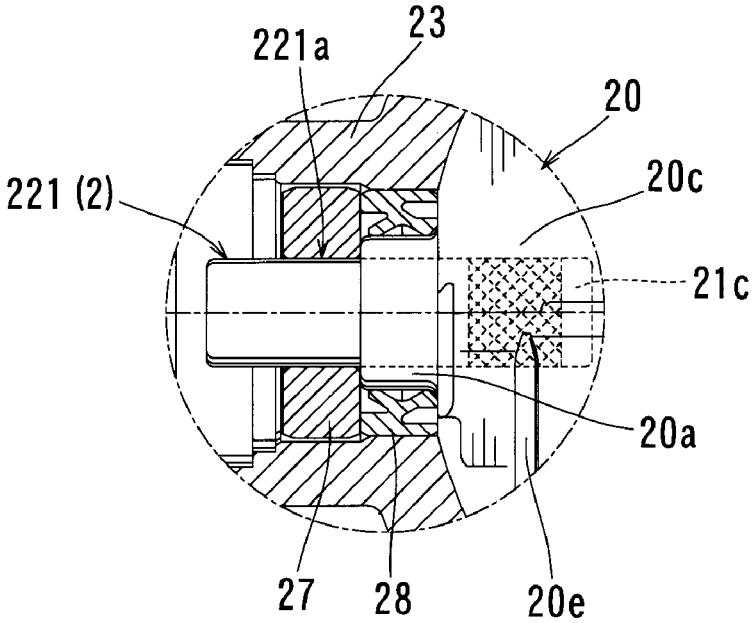
FIG. 10 is an enlarged view of a region X of FIG. 8.

As shown in FIGS. 9 and 10, the seal members 28 are fitted onto the cylindrical sleeve portions 20*a* in the same manner as the above embodiment. However, the bearings 27 are directly fitted onto the shaft members 221(1) and 221(2). Therefore, portions of the shaft members 221(1) and 221(2) are configured as support shaft portions 221*a* that correspond to the support shaft portions 21*a* of the above embodiment. The shaft members 221(1) and 221(2) including the support shaft portions 221*a* have the same diameter as the diameter ød of the support shaft portions 21*a* of the above embodiment (see FIG. 11). Thus, the diameter of the shaft members 221(1) and 221(2) is larger than the diameter of the shaft members 21(1) and 21(2) of the above embodiment.

A connecting shaft portion 221*b* is formed on the radially outer end of the drive-side shaft member 221(1) via a stepped face 221*e*, so that the connecting shaft portion 221*b* has the same outer diameter as the connecting shaft portion 21*b* of the above embodiment (see FIG. 9). The drive-side shaft member 221(1) is positioned on the right side as viewed in FIG. 8.

A method of coupling the drive-side shaft member 221(1) to the throttle gear 37 will now be described. First, the connecting shaft portion 221*b* of the shaft member 221(1) is fitted into the coupling hole 44 formed in the coupling member 43 of the throttle gear 37 (see FIG. 9). At the same time, the stepped face 221*e* of the shaft member 221(1) is brought to contact with the end face of the coupling member 43, which axially opposes to the stepped face 221*e*.

Thereafter, a clearance in the fully closed position of the throttle valve 213 is adjusted in the same manner as described in connection with the above embodiment. Subsequently, the connecting shaft portion 221*b* of the drive-side shaft member 221(1) and the coupling member 43 are joined together by laser-welding along the entire circumference of the connecting shaft portion 221*b*.

Also according to the throttle valve 213 of this embodiment and the throttle control device 10 incorporating the throttle valve 213, substantially the same advantages as the above embodiment can be achieved.

The present invention may not be limited to the above embodiments but may be modified in various ways. For example, although the above embodiments have been described in connection with butterfly valves used as throttle valves 13 (213), the present invention can be applied to any other butterfly valves that are used for opening and closing a flow channel, through which a fluid flows. Although the outer diameter ød of the shaft support portions 21*a* (221*a*) and the thickness t of the plate-like portion 20*d* of the valve body 20 are determined such that they satisfy an expression of ød≧t, it is possible to determine such that they satisfy an expression of ød<t.

Although the rugged part (engaging part) 21*d* is formed on the embedded portion 21*c* of each of the shaft members 21(1) and 21(2) (221(1) and 221(2)) in the above embodiments, the rugged part (engaging part) 21*d* may be formed on only one of the shaft members, such as the drive-side shaft member 21(1) (221(1)). In addition, although the rugged part (engaging part) 21*d* is configured to prevent the valve body 20 from rotating and moving in the axial direction, it is possible to configure the rugged part (engaging part) 21*d* such that the rugged part can prevent only the rotation of the valve body 20 or only the axial movement of the valve body 20. Further, the rugged part may be provided as occasion demands, and therefore, the rugged part may be omitted.

Further, although the shaft members 21(1) and 21(2) (221(1) and 221(2)) are made of different materials from each other in the above embodiments, the shaft members may be made of the same material that can be a metal material or a resin material. It is also possible to form the drive-side shaft member 21(1)(221(1)) of a metal material and to form the driven-side shaft member 21(2)(221(2)) of a resin material.

Furthermore, it is possible to form the connecting shaft portion 21*b* (221*b*) as a separate member from the drive-side shaft member 21(1)(221(1)). In such a case, the connecting shaft portion may be joined to the drive-side shaft member. The seal members 28 can be directly fitted onto the respective shaft members 21(1) and 21(2) (221(1) and 221(2)).

This invention claims:

1. A butterfly valve comprising:

a support member defining a flow path;

a plate-like valve body positioned within the flow path for opening and closing the flow path; and a shaft integrated with the valve body by an insertion molding process;

wherein the shaft comprises a first shaft member and a second shaft member, and wherein the first and second shaft members are spaced from each other in an axial direction by a predetermined distance.

2. The butterfly valve as in claim 1, wherein:

the valve body has a support shaft portion supported by the support member via bearings;

the valve body has a plate-like portion positioned between the first and second shaft members; and the following expression is satisfied:

$$\text{ød} \geqq t$$

where ød is an outer diameter of the support shaft portion and t is a thickness of the plate-like portion.

3. The butterfly valve as in claim 1, wherein:

each of the first and second shaft members has a support shaft portion supported by the support member via a bearing;

the valve body has a plate-like portion positioned between the first and second shaft members; and the following expression is satisfied:

$$\text{ød} \geqq t$$

where ød is an outer diameter of the support shaft portion and t is a thickness of the plate-like portion.

4. The butterfly valve as in claim 1, wherein:

the valve body is made of resin material;

each of the first and second shaft members has an embedded portion embedded within the valve body; and the embedded portion of at least one of the first and second shaft members comprises an engaging portion engaging with the resin material of the valve body.

5. The butterfly valve as in claim 4, wherein the engaging portion is configured to prevent the valve body from rotating about the rotational axis relative to the at least one of the first and second shaft members.

6. The butterfly valve as in claim 4, wherein the engaging portion is configured to prevent the valve body from moving in the axial direction relative to the at least one of the first and second shaft members.

7. The butterfly valve as in claim 4, wherein the engaging portion comprises a rugged portion formed by knurling.

8. The butterfly valve as in claim 1, wherein the first shaft member and the second shaft member are made of different materials from each other.

9. The butterfly valve as in claim 8, further comprising a drive device coupled to the first shaft member via a metal coupling member, wherein the first shaft member is laser-welded to the metal coupling member.

10. The butterfly valve as in claim 9, wherein each of the coupling member and the first shaft member is made of stainless steel, and wherein the second shaft member is made of carbon steel with high carbon content.

11. An intake air control device for an internal combustion engine, comprising the butterfly valve as in claim 1, wherein:

the butterfly valve comprises a throttle valve, the support member comprises a throttle body defining a bore as the flow path, so that an intake air can flow through the bore, and the throttle valve is rotatably supported by the throttle body, so that an amount of the intake air flowing through the bore can be controlled as the bore is opened and closed by the throttle valve.

12. A butterfly valve comprising:

a support member defining a flow path;

a valve body disposed within the flow path and rotatable about a rotational axis;

a shaft comprising a first shaft member and a second shaft member disposed on opposite sides of the valve body along the rotational axis;

wherein the valve body includes shaft covering portions, so that the first and second shaft members are inserted into the shaft covering portions;

wherein the first shaft member and the second shaft member are spaced from each other along the rotational axis by a predetermined distance; and wherein the shaft covering portions include first sleeve portions; and bearings interposed between the support member and the first sleeve portions, so that the shaft covering portions are rotatably supported by the support member via the bearings.

13. The butterfly valve as in claim 12, wherein the shaft covering portions further include second sleeve portions formed in continuity with the first sleeve portions, and wherein the butterfly valve further comprises seal members interposed between the support member and the second sleeve portions.

14. The butterfly valve as in claim 12, wherein the valve body is made of resin and the first and second shaft members are made of metal.

15. A butterfly valve comprising:

a support member defining a flow path;

a valve body disposed within the flow path and rotatable about a rotational axis;

a shaft comprising a first shaft member and a second shaft member disposed on opposite sides of the valve body along the rotational axis;

wherein the valve body includes shaft covering portions, so that the first and second shaft members are inserted into the shaft covering portions;

wherein the first shaft member and the second shaft member are spaced from each other along the rotational axis by a predetermined distance;

wherein the shaft covering portions include sleeve portions; and wherein the first shaft member and the second shaft member have shaft portions extending outward from the sleeve portions;

bearings interposed between the support member and the shaft portions of the first and second shaft members, so that the first and second shaft members are rotatably supported by the support member via the bearings; and seal members interposed between the support member and the sleeve portions of the shaft covering portions.

16. The butterfly valve as in claim 15, wherein the valve body is made of resin and the first and second shaft members are made of metal.

* * * * *